US007731184B2

(12) United States Patent
Lo et al.

(10) Patent No.: US 7,731,184 B2
(45) Date of Patent: Jun. 8, 2010

(54) DUPLEXER

(75) Inventors: Kevin Lo, Vancouver, WA (US); Richard S. Smith, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 878 days.

(21) Appl. No.: 11/182,684

(22) Filed: Jul. 15, 2005

(65) Prior Publication Data

US 2007/0013120 A1 Jan. 18, 2007

(51) Int. Cl.
*B65H 29/00* (2006.01)

(52) U.S. Cl. ..... 271/186; 271/65

(58) Field of Classification Search ..... 271/186, 271/65, 291, 902; 399/309, 364
See application file for complete search history.

(56) References Cited

U.S. PATENT DOCUMENTS 4,348,101 A * 9/1982 Schonfeld et al. ..... 399/401
4,534,643 A * 8/1985 Watanabe ..... 399/403
4,579,325 A * 4/1986 Pinckney et al. ..... 271/3.03
4,579,326 A * 4/1986 Pinckney et al. ..... 271/3.03
4,714,241 A * 12/1987 Randall ..... 271/3.03
4,806,979 A * 2/1989 Tokoro et al. ..... 399/401
4,815,378 A * 3/1989 Stienstra ..... 101/230
4,858,909 A * 8/1989 Stemmle ..... 271/184
4,881,729 A * 11/1989 Culligan et al. ..... 271/3.05
4,918,490 A * 4/1990 Stemmle ..... 399/401
4,925,176 A * 5/1990 Acquaviva ..... 271/3.03
4,928,127 A * 5/1990 Stemmle ..... 399/364
4,979,727 A * 12/1990 Koike et al. ..... 271/3.03
5,022,640 A 6/1991 Greco, Jr.
5,055,885 A * 10/1991 Yoshikado et al. ..... 399/401
5,081,508 A * 1/1992 Kotani et al. ..... 399/21
5,091,755 A * 2/1992 Tashiro ..... 399/374
5,121,912 A * 6/1992 Tashiro ..... 271/3.05
5,225,881 A * 7/1993 Goto et al. ..... 399/402
5,234,213 A 8/1993 Chen
5,280,331 A 1/1994 Namiki
5,332,209 A * 7/1994 Romansky et al. ..... 271/171
5,384,619 A 1/1995 Yokomizo et al.
5,415,391 A 5/1995 Wong et al.
5,448,348 A * 9/1995 Azeta ..... 399/364
5,478,061 A * 12/1995 Murakami et al. ..... 270/58.08
5,511,771 A * 4/1996 Rubscha ..... 271/4.01
5,666,629 A 9/1997 Kazoh
5,784,680 A * 7/1998 Taruki ..... 399/374
5,883,660 A 3/1999 Kato et al.
5,887,865 A * 3/1999 Ishimaru ..... 271/4.1
5,923,360 A * 7/1999 Mori ..... 347/262
5,926,681 A 7/1999 Ishimaru
5,966,556 A * 10/1999 Nakagawa et al. ..... 399/18
6,029,020 A 2/2000 Blackman et al.
6,081,688 A * 6/2000 Okada et al. ..... 399/374

(Continued)

FOREIGN PATENT DOCUMENTS

JP 2006143378 A * 6/2006

(Continued)

*Primary Examiner*—Patrick Mackey
*Assistant Examiner*—Michael C McCullough

(57) ABSTRACT

Various embodiments of a duplexer are disclosed in which a guide directs a sheet to a first transport which continues to move the sheet in a first direction or moves the sheet in an opposite direction to subsequently overturn the sheet.

21 Claims, 6 Drawing Sheets

U.S. PATENT DOCUMENTS 6,144,814 A 11/2000 Newell, Jr. et al.
6,167,231 A 12/2000 Blackman et al.
6,185,381 B1 * 2/2001 Nakahara et al. ..... 399/21
6,195,151 B1 2/2001 Parthasarathy et al.
6,215,976 B1 * 4/2001 Shida et al. ..... 399/367
6,250,754 B1 6/2001 Bortolotti
6,259,884 B1 7/2001 Oberhoffner
6,267,371 B1 * 7/2001 Jessop ..... 271/171
6,290,410 B1 * 9/2001 Sunada et al. ..... 400/624
6,332,068 B2 12/2001 Blackman et al.
6,393,251 B2 * 5/2002 Kono ..... 399/370
6,397,023 B1 5/2002 Underwood et al.
6,434,359 B2 * 8/2002 Nose et al. ..... 399/374
6,474,387 B1 * 11/2002 Shimao ..... 156/364
6,487,382 B2 11/2002 Underwood et al.
6,496,661 B2 12/2002 Ando et al.
6,511,239 B1 1/2003 Kretschmann et al.
6,511,241 B2 1/2003 Fetherolf et al.
6,522,860 B2 * 2/2003 Nose et al. ..... 399/374
6,529,259 B1 * 3/2003 Kono ..... 355/23
6,533,271 B1 * 3/2003 Zimmermann ..... 271/303
6,585,258 B1 * 7/2003 Hirota et al. ..... 271/186
6,612,566 B2 9/2003 Stoll
6,648,320 B2 * 11/2003 Iino et al. ..... 271/3.15
6,669,190 B1 12/2003 Wei
6,719,469 B2 * 4/2004 Yasui et al. ..... 400/603
6,741,826 B2 5/2004 Park et al.
6,764,236 B2 * 7/2004 Suzuki ..... 400/642
6,814,353 B1 * 11/2004 Kakuta et al. ..... 271/186
6,987,525 B2 * 1/2006 Choi ..... 347/262
7,020,429 B2 * 3/2006 Hamada et al. ..... 399/367
7,079,805 B2 * 7/2006 Suzuki ..... 399/401
7,212,321 B2 * 5/2007 Sugiyama et al. ..... 358/498
7,467,790 B2 * 12/2008 Westhoff ..... 271/3.14
2003/0193135 A1 * 10/2003 Suzuki ..... 271/303
2004/0140606 A1 * 7/2004 Kobayashi et al. ..... 271/4.01
2004/0178565 A1 * 9/2004 Reeves ..... 271/225
2004/0179878 A1 9/2004 Eskey
2004/0217537 A1 * 11/2004 Ohama ..... 271/3.14
2005/0012259 A1 * 1/2005 Sano et al. ..... 271/10.01
2007/0080490 A1 * 4/2007 Tu ..... 271/3.14

FOREIGN PATENT DOCUMENTS

JP 2006290589 A * 10/2006

* cited by examiner

DUPLEXER

BACKGROUND

In some instances, it is desirable to print upon or read from both sides of a sheet of media. Manually overturning sheets of media may be inconvenient. Existing duplexing devices may be complex and expensive.

DETAILED DESCRIPTION OF EXAMPLE EMBODIMENTS

Figure 1:
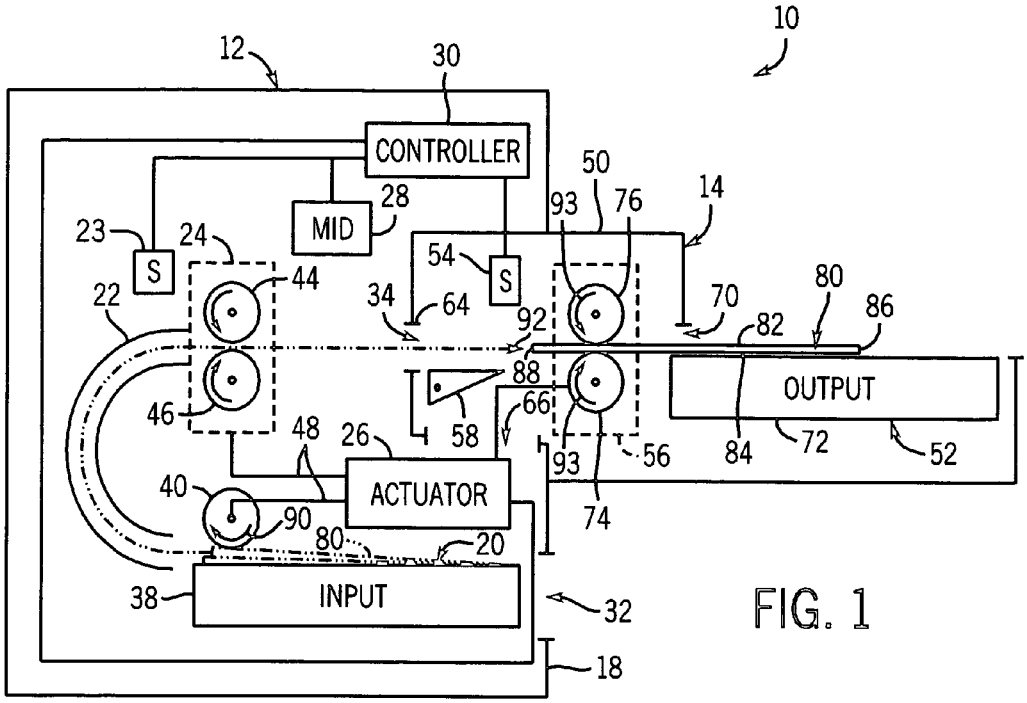
FIG. 1 is a schematic illustration of a duplexer system according to one example embodiment.

FIG. 1 schematically illustrates duplexer system 10 which generally includes media interaction system 12 and duplex accessory 14. Media interaction system 12 is configured to interact with media. For purposes of this disclosure, the term "interact" shall mean to at least one of writing to media and reading from media. For example, writing to media may comprise printing or otherwise depositing an imaging material upon the media. Reading from media may comprise scanning or otherwise sensing data or printing material upon media. Media interaction system 12 generally includes housing 18, input 20, media overturning path 22, sensor 23, media transport 24, actuator 26, media interaction device 28 and controller 30. Housing 18 comprises one or more structures configured to support and substantially enclose the remaining components of system 12. In one embodiment, housing 18 may include an opening 32 providing access to input 20 and an opening 34 allowing media to be discharged from housing 18. The configuration as well as the locations of openings 32 and 34 may be varied depending upon the overall arrangement of system 12.

Input 20 comprises one or more structures or mechanisms configured to facilitate the inputting or supplying of media to systems 10 and 12. In one embodiment, input 20 includes feed tray 38 and pick device 40. Feed tray 38 comprises an elongate tray configured to hold a stack of sheets of media. In one embodiment, tray 38 is at least partially inserted into housing 18 through opening 32 to a position such that pick device 40 extends opposite to the stack of sheets of media held by tray 38. In other embodiments, feed tray 38 may be stationarily coupled to housing 18 while being configured to guide manual insertion of one or more sheets through opening 32 to a position opposite to pick device 40.

Pick device 40 comprises a device configured to pick a sheet of media from feed tray 38 and to move the picked sheet at least towards overturning path 22. In one embodiment, pick device 40 comprises a pick tire which is configured to be rotatably driven against an uppermost sheet in feed tray 38. In other embodiments, pick device 40 may comprise other mechanisms such as belts and the like. In other embodiments, pick device 40 may additionally include one or more separation rollers or other devices (not shown) configured to inhibit picking of multiple sheets.

Media overturning path 22 comprises a path extending from input 20 along which media is moved and overturned as it travels towards media interaction device 28. In one embodiment, media overturning path 22 may comprise one or more stationary structures which guide and direct media. In still other embodiments, media overturning path 22 may include one or more rollers or other bearing structures along with guide and overturn media.

Sensor 23 comprises a device configured to sense the presence or movement of media along media path 22. Sensor 23 communicates signals indicating the presence or absence of media to controller 30. In the embodiment illustrated, sensor 23 is illustrated as being positioned to above or to the outside of media path 22. In other embodiments, sensor 23 may be located below or to the inside of media overturning path 22. In one embodiment, sensor 23 comprises an optical sensor. In still another embodiment, sensor 23 may comprise a flag or trigger which is engaged by media. Although sensor 23 is illustrated as a single sensing device, sensor 23 may alternatively comprise multiple distinct sensing devices positioned at various locations along media path 22.

Media transport 24 comprises a mechanism configured to engage and move media along path 22 and relative to media interaction device 28. In one embodiment, media transport 24 comprises opposing rollers 44, 46, at least one of which is rotatably driven. In other embodiments, media transport 24 may comprise a single roller, or one or more belts or other structures configured to engage and move media. Although media transport 24 is illustrated as including a single pair of rollers 44, 46, media transport 24 may alternatively include multiple sets of rollers or other devices spaced from one another along path 22 configured to move media.

Actuator 26 (shown in FIG. 1 but omitted in FIG. 2 for ease of illustration) comprises one or more mechanisms configured to actuate and drive media pick device 40 and media transport 24. In one embodiment, actuator 26 comprises a motor configured to supply torque to media pick device 40 and media transport 24 through one or more transmissions 48. In other embodiments, actuator 26 may comprise other mechanisms for driving device 40 and transport 24.

Media interaction device 28 comprises a device configured to write to and/or read from media along path 22. In one embodiment, media interaction device 28 comprises a device configured to print or otherwise write data to media. For example, in one embodiment, media interaction device 28 comprises one or more inkjet printheads configured to print ink upon a face of media. In one embodiment, the inkjet printheads comprise page-array printheads. In another embodiment, media interaction device 28 comprises an electrostatic print engine. In another embodiment, media interaction device 28 comprises one or more printheads movably supported by a carriage which is scanned across the media during printing. In still other embodiments, media interaction device 28 comprises a device configured to read or otherwise sense images or data from media. For example, media interaction device 28 may comprise a scanning component configured to scan printed images upon a face of media. In particular embodiments, media interaction device 28 may also be configured to detect media properties and physical boundaries such as to detect edges of media.

Controller 30 comprises a processing unit configured to generate control signals directing the operation of actuator 26 and media interaction device 28. For purposes of this disclosure, the term "processing unit" shall include a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 30 is not limited to any specific combination of hardware circuitry and software, nor to any particular source for the instructions executed by the processing unit. In one embodiment, controller 30 receives image data and generates control signals based upon image data to pick one or more sheets of media from feed tray 38 and to control media interaction of device 28 to print the image upon the picked sheets. In another embodiment, controller 30 generates control signals to pick sheets already containing data or print from feed tray 38 and to sense or read such data and potentially store such data.

Duplexer accessory 14 comprises a device configured to facilitate duplexing of media after such media has been interacted upon by interaction system 12. Duplexer accessory 14 comprises a device configured to be removably connected to system 12, allowing system 12 to be upgraded for duplexing. Accessory 14 generally includes housing 50, output 52, sensor 54, media transport 56 and guide 58. Housing 50 comprises one or more structures configured to supply and enclose the remaining components of duplexer accessory 14. Housing 50 is further configured to releasably mate, connect or interlock with housing 18 of system 12 to appropriately align and position accessory 14 with respect to opening 34 and the remaining components of system 12. Housing 50 may have multiple sizes, shapes and configurations.

In the example illustrated, housing 50 includes an opening 64 configured to align with opening 34 of housing 18 so as to enable media to pass from system 12 into accessory 14 and an additional opening 66 configured to permit media to pass through housing 50 into system 12 towards input 20. The size, shape and configuration of openings 64 and 66 may vary depending upon the size, shape and relationship of system 12 and accessory 14. In other embodiments, in lieu of being formed by interaction system 12 and a releasably connectable module or accessory 14, duplexer system 10 may alternatively include the components of system 12 and accessory 14 as a single unit supported and substantially enclosed by a single housing.

Output 52 comprises a structure configured to separate completed media from media yet to be interacted upon by system 12. Output 52 is configured to enable the completed media to be accessed and removed from system 10. In one embodiment, output 52 comprises a discharge opening 70 and an output tray 72. Discharge opening 70 comprises an opening in housing 50 through which the completed media is expelled. Output tray 72 comprises one or more structures upon which or in which completed media is stored until manual retrieval by a person. In particular embodiments, output 52 may include multiple output trays 72 separating distinct outputs from system 12. In still other embodiments, output tray 72 may be omitted.

Sensor 54 comprises one or more devices configured to detect the positioning of media with respect to guide 58. In one embodiment, sensor 54 may comprise a device configured to transmit signals to controller 30 representing the positioning of media with respect to guide 58. In one embodiment, the connection of accessory 14 to system 12 results in the electrical connection between sensor 54 and controller 30. In still other embodiments, sensor 54 may communicate with controller 30 wirelessly. In one embodiment, sensor 54 may comprise an optical sensor. In still another embodiment, sensor 54 may comprise a flag or trigger which is engaged by media. In lieu of communicating with controller 30, sensor 54 may alternatively automatically interact with a transmission connecting actuator 26 and transport 56 to alter the operation of actuator 26 and/or transport 56 in response to the particular positioning of media with respect to guide 58. In still other embodiments, sensor 54 may be omitted where positioning of media with respect to guide 58 may be determined or known in other fashions such as based upon a speed at which pick device 40 or media transport 24 is moving media or from other sensing devices such as sensor 23 or media interaction device 28.

Guide 58 comprises one or more structures configured to direct or channel media between media interaction device 28 and media transport 56. In one embodiment, guide 58 is specifically configured such that media moving towards output 52 is moved across and is supported by guide 58 as the media moves from media interaction device 28 to media transport 56. Guide 58 is configured such that medium moving in an opposite direction away from output 52 engages an under side of guide 58 and is directed through opening 66 towards pick device 40 of input 20. In one particular embodiment, guide 58 is configured to direct media from media interaction device 28 to media transport 56 and to direct media from transport 56 to input 20 while remaining stationary. In another embodiment, guide 58 is movable between a first discharge position (shown in solid lines in FIG. 1) in which media is directed from media interaction device 28 to media transport 56 and a second duplex position (shown with solid lines in FIG. 2) in which media is directed from media transport 56 to input 20. In such an embodiment, guide 58 may be moved between the discharge position and the duplex position by a powered actuator, such as actuator 26 of system 12 or by another powered actuator provided as part of accessory 14. Where actuator 26 of system 12 supplies force to actuate guide 58 between the discharge position and the duplex position, accessory 14 is configured to operably connect with actuator 26 or a transmission connected to actuator 26 when accessory 14 is connected to system 12. In some embodiments, guide 58 may alternatively be manually actuated between the discharge position (FIG. 1) and the duplex position (FIG. 2).

Media transport 56 comprises one or more devices configured to move media. Media transport 56 is supported between media guide 58 and output 52. Media transport 56 is configured to move media towards and through opening 70 of output 52 and to also move media from output 52 towards guide 58 and towards input 20 without disengaging the media. In one embodiment, media transport 56 includes a pair of rollers 74, 76 opposing one another and configured to engage opposite faces of media. At least one of rollers 74, 76 is operably connected to actuator 26 so as to be rotatably driven. In such an embodiment, accessory 14 includes a transmission configured to be operably coupled to actuator 26 or a transmission connected to actuator 26 when accessory 14 is connected to system 12. In yet another embodiment, media transport 56 may be driven by a separate actuator associated with accessory 14. In yet other embodiments, other devices for moving media such as conveyors, belts and the like may be utilized in lieu of rollers 74, 76.

Figure 2:
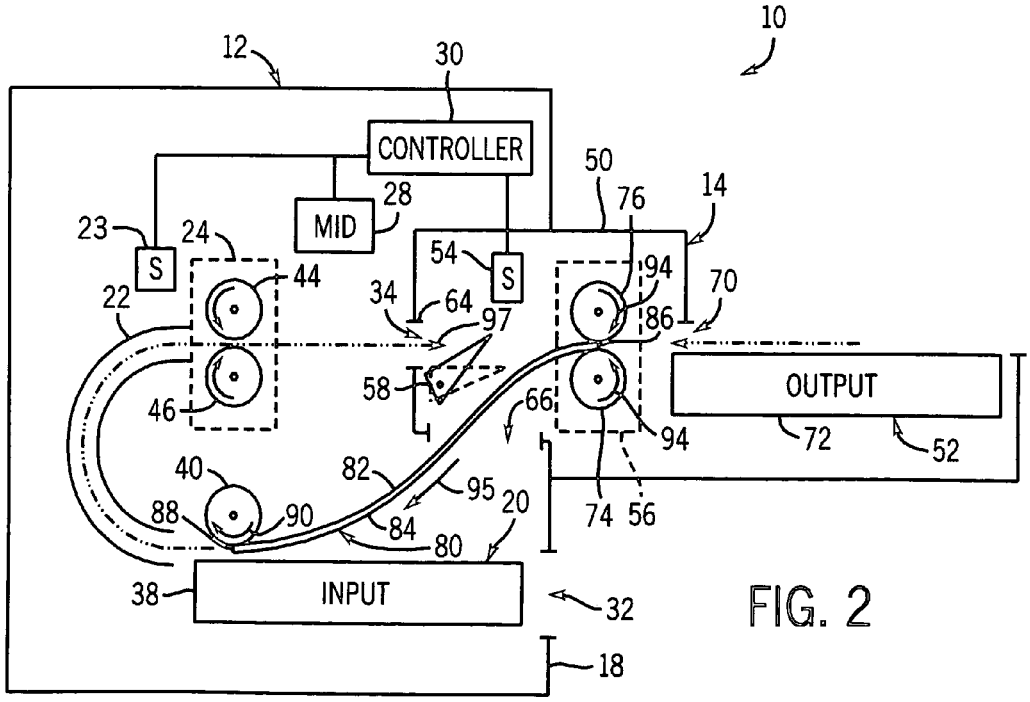
FIG. 2 is a schematic illustration of the duplexer system of FIG. 1 illustrating duplexing of media according to one example embodiment.

FIGS. 1 and 2 illustrate general operation of system 10. In particular, FIGS. 1 and 2 illustrate duplexing of a sheet 80 of media having a first face 82, a second opposite face 84 and edges 86, 88. Sheet 80 is schematically shown in FIGS. 1 and 2 and may have various lengths between edges 86 and 88 and alternative proportions with respect to system 10.

As shown by FIG. 1, sheet 80 is initially placed in input 20. In one embodiment, sheet 80 may be placed within tray 38 and tray 38 may be positioned through opening 32 to a position opposite pick device 40. In another embodiment, sheet 80 may be manually inserted through opening 32 to a position opposite to pick device 40.

In response to receiving an operation command, controller 30 generates control signals directing actuator 26 to rotatably drive pick device 40 in the direction indicated by arrow 90 so as to pick sheet 80 and move sheet 80 from input 20 along path 22 as indicated by arrow 92. Media transport 24 further engages sheet 80 to facilitate movement of sheet 80 along path 22 and relative to media interaction device 28. As sheet 80 is moved along path 22, sheet 80 is overturned such that face 82 which was facing downward faces in an upward direction as seen in FIG. 1. Controller 30 further generates control signals directing media interaction device 28 to interact with face 82 of sheet 80. In one embodiment, media interaction device 28 prints or otherwise deposits printing material upon face 82. In another embodiment, media interaction device 28 reads or scans information or print from face 82 and detects edges 86 and 88. Media transport 24 moves sheet 80 past media interaction device 28 across guide 58, which is in the discharge position, to media transport 56. Controller 30 generates control signals directing actuator 26 to drive media transport 56 in the direction indicated by arrows 93 such that sheet 80 is at least partially discharged through opening 70 to output tray 72 of output 52 as shown in FIG. 1.

As shown in FIG. 2, sensor 54 (and/or sensor 23 or device 28 in some embodiments) senses the positioning of sheet 80. Upon sensing movement of edge 88 of sheet 80 past guide 58, sensor 54 transmits signals to controller 30. In response to these signals, controller 30 generates control signals directing actuator 26 (or alternatively the transmission interconnecting actuator 26 and media transport 56) to rotatably drive media transport 56 in an opposite direction as indicated by arrows 94. This reversing of media transport 56 occurs prior to complete release of sheet 80 from media transport 56. In the embodiment shown, this reversing of rollers 74, 76 occurs prior to disengagement of rollers 74, 76 from sheet 80 while a portion of sheet 80 is within output 52. Reversing of the direction at which media transport 56 drives sheet 80 results in sheet 80 moving in the direction indicated by arrow 95. During the reversal of movement of sheet 80, edge 88 which was previously the trailing edge becomes the leading edge. During such movement, sheet 80 engages guide 58 and is directed by guide 58 to pick device 40 of input 20. As shown by FIG. 2, during such movement, sheet 80 engages an opposite side of guide 58 as compared to when sheet 80 moved across guide 58 to media transport 56.

As shown in solid in FIG. 2, in one embodiment, in response to receiving signals from sensor 54 indicating that edge 88 has passed guide 58, controller 30 may generate control signals directing actuator 26 to move guide 58 from a discharge position (shown in phantom) to a duplex position. Movement of guide 58 to the duplex position enhances the ability of guide 58 to more reliably direct sheet 80 to input 20.

Upon sheet 80 being redirected to input 20, controller 30 generates control signals directing actuator 26 to drive pick device 40 to once again move sheet 80 along path 22 in the direction indicated by arrow 97. In one embodiment, sensor 54 continues to detect the positioning of sheet 80 such as when edge 86 of sheet 80 has moved past sensor 54. In response to release of sheet 80 by media transport 56 and/or movement of edge 86 past sensor 54, sensor 54 transmits signals to controller 30, wherein controller 30 generates control signals directing actuator 26 to rotatably drive pick device 40 in the direction indicated by arrow 90 and to rotatably drive media transport 56 in the direction indicated by arrows 93 (shown in FIG. 1). In those embodiments in which guide 58 is movable between a discharge position and a duplex position, controller 30 further generates control signals directing actuator 26 to move guide 58 from the duplex position (shown in solid in FIG. 2) back to the discharge position (shown in phantom lines). Because sheet 80 is again overturned as it moves along path 22, media interaction device 28 may read and/or write to an opposite face, face 84, of sheet 80. Once the opposite face of sheet 80 has been printed upon or read from, sheet 80 is once again moved across guide 58 to media transport 56. However, controller 30 generates control signals directing media transport 56 to move sheet 80 substantially into output 52 and to release sheet 80 from media transport 56. Thereafter, a person may access and remove sheet 80 from output 52.

Overall, some embodiments of system 10 may provide a compact and low-cost device for reading and/or writing to both faces of media. In particular, some embodiments of system 10 may utilize a media overturning path 22 of system 12 that enables media to be input and discharged from system 12 along substantially the same face, such as the front, of system 12 to facilitate duplexing. Some embodiments of system 10 may automatically feed media back to the input of system 12 to utilize the U-shaped configuration of path 22. As a result, additional dedicated paths for overturning media to allow duplexing may be omitted, potentially reducing cost, complexity and space consumption, according to some embodiments. Because media transport 56 reverses the direction of movement of media for duplexing without disengaging or releasing such media being duplexed, control is maintained over positioning of sheet 80, enhancing reliability of some embodiments of system 10. Because some embodiments of system 10 may utilize output 52 for containing the media prior to the media being directed back to input 20, additional volume for otherwise containing media during duplexing is not needed. Because some embodiments of system 10 may utilize input 20 which is used for inputting or supplying media to system 12, additional volume or space for inputting media being duplexed may be omitted. Because the architecture of some embodiments of system 10 enables media interaction device 28 to overlie feed tray 38 of input 20, some embodiments of system 10 may be compact.

Figure 3:
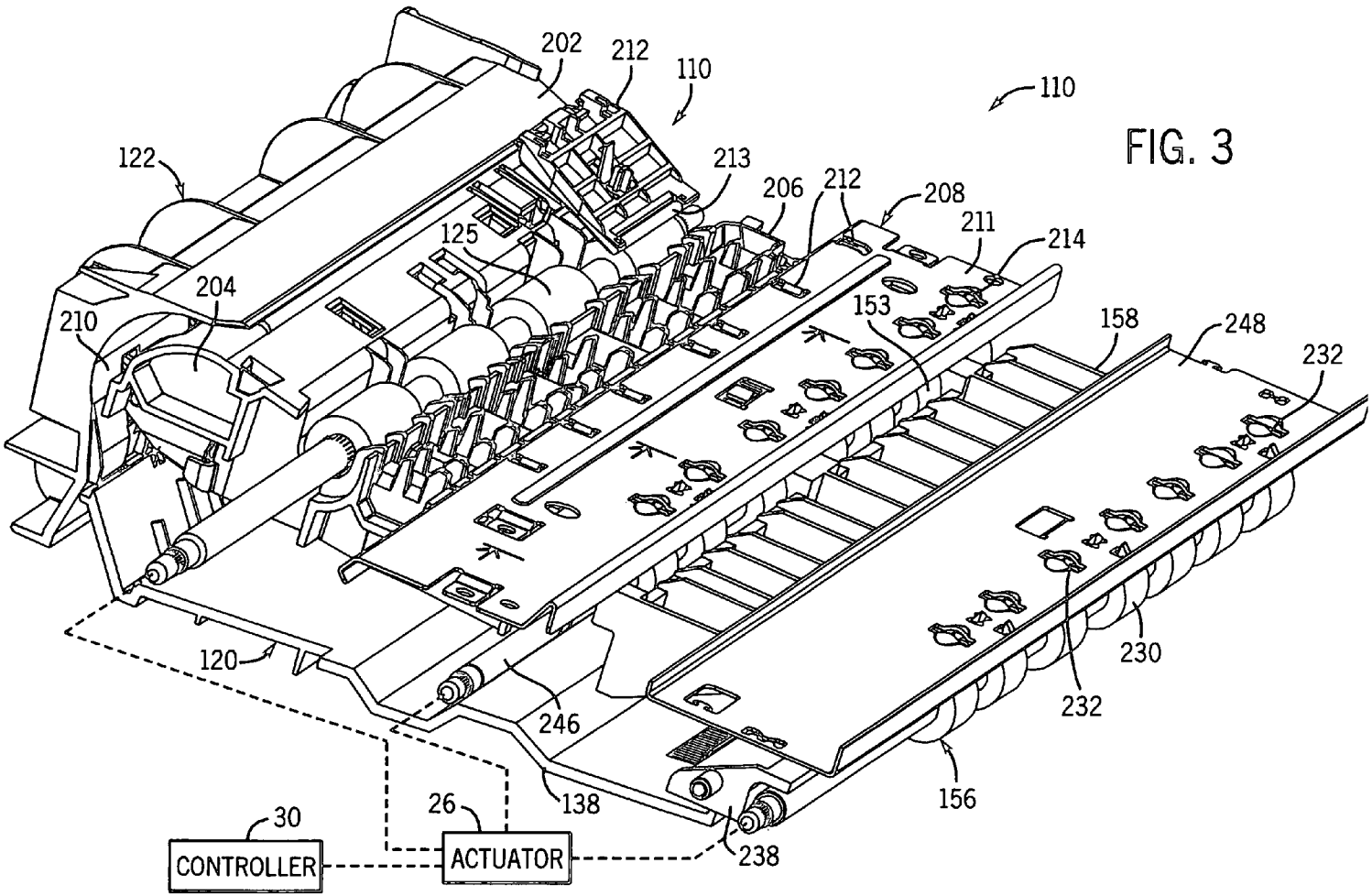
FIG. 3 is a top perspective view of another embodiment of the duplexer system of FIG. 1 according to one example embodiment.
Figure 4:
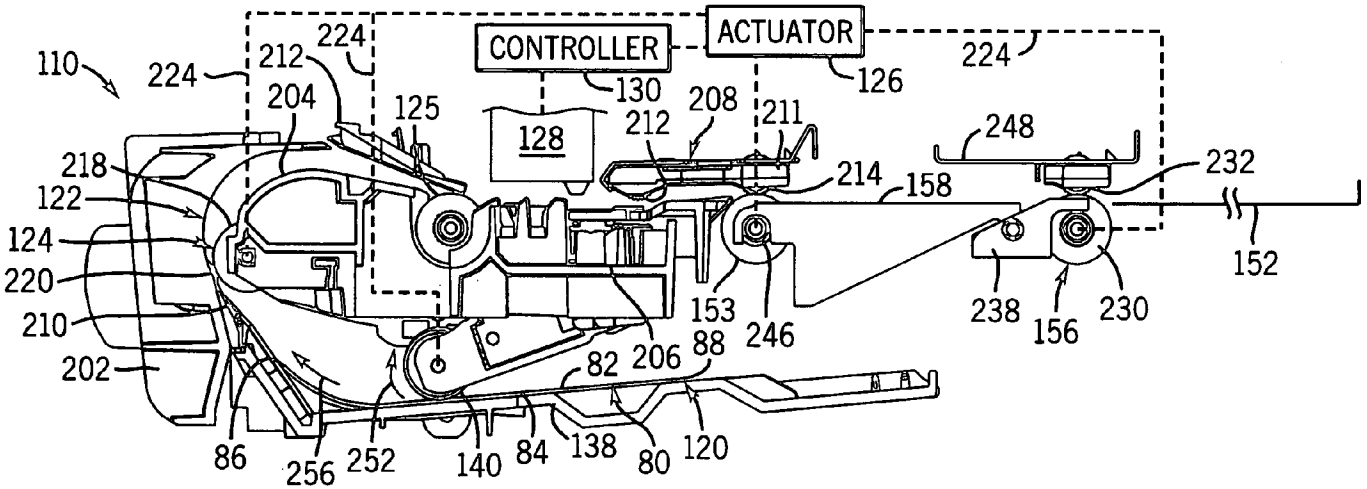
FIG. 4 is a side elevational view of the duplexer system of FIG. 3 illustrating picking of a sheet of media according to one example embodiment.

FIGS. 3 and 4 illustrate media interaction system 110, one example embodiment of system 10 shown and described with respect to FIGS. 1 and 2. Unlike media interaction system 10, media interaction system 110 is configured as a single integrated unit. Media interaction system 110 generally includes input 120, media overturning path 122, media transports 124, 125, actuator 126, media interaction device 128, controller 130, output 152, media transport 153, media transport 156 and guide 158. Media input 120 directs sheets of media into media path 122 for interaction by media interaction device 128. In the example shown, media input 120 includes media tray 138 and pick device 140. Tray 138 receives and supports one or more sheets of media and guides such sheets to pick device 140. Pick device 140 comprises a pick tire configured to engage an individual sheet of media and to drive the individual sheet of media into media path 122. Feed tray 138 is configured to receive sheets of media manually input through an opening 32 and housing 18 (shown in FIG. 1) of system 110.

In other embodiments, feed tray 138 involves pick device 140 which may have other configurations and may comprise one or more other structures for facilitating manual input of sheets of media to pick device 140 and for picking individual sheets of media and urging such sheets into path 122.

Media overturning path 122 comprises a path extending from input 120 across media interaction device 128 to media transport 153. Path 122 is configured to overturn sheets of media as they move along the path. In one embodiment, path 122 facilitates inputting and outputting of media from a common side or face of system 110. Path 122 generally includes outer director 202, inner director 204, media support 206 and end director 208. Outer director 202 and inner director 204 comprise one or more structures supported relative to one another so as to form a U-shaped channel 210 therebetween for directing and guiding movement of media. Media support 206 comprises one or more structures positioned opposite media interaction device 128 and configured to support media as device 128 interacts with the media. In one embodiment, media support 206 may include a platen for supporting the media and may additionally include ink receiving cavities (not shown) to facilitate borderless, edge-to-edge inkjet printing. End director 208 comprises structures supported between media interaction device 128 and media transport 153 opposite to media support 206 and configured to further direct interacted upon media to media transport 153. In one embodiment, end director 208 includes a frame structure 211 supporting several arrangements of single and paired star wheels 212 and 214. In other embodiments, media overturning path 122 may have other configurations and may be provided by other structures.

Media transport 124 comprises a mechanism situated along media path 122 so as to facilitate movement of media along path 122. In the particular example shown, media transport 124 comprises a roller configured to be rotatably driven by actuator 126 and supported by inner director 204 opposite to outer director 202 to move media between directors 202 and 204. In the examples shown, media transport 124 additionally includes an idler or pinch roller 220 supported by outer director 202 opposite to drive roller 218. In other embodiments, drive roller 218 may engage media against outer director 202. In still other embodiments, media transport 124 may comprise other structures such as belts and the like to move media or may be omitted.

Media transport 125 comprises a mechanism situated along media path 122 and configured to drive media. In the particular example shown, media transport 125 comprises rotatably driven rollers supported by inner director 204 opposite to outer guide 212 and pinch roller 213 (shown in FIG. 3) proximate to media support 206. Although FIG. 3 depicts a single guide 212 and a single pinch roller 213, system 110 may include a guide 212 and pinch roller 213 for each driven roller of media transport 125. In other embodiments, media transport 125 may comprise other structures such as belts and the like for moving media or may be omitted.

Actuator 126 comprises a mechanism configured to rotatably drive pick device 140, roller 218 of media transport 124 and media transport 125. Actuator 126 is further configured to rotatably drive media transport 153 and media transport 156. In one embodiment, actuator 126 may also be configured to linearly translate or scan media interaction device 128 relative to media supported by media support 206. Actuator 126 may comprise an electric motor operably coupled to pick device 140, roller 218, media transport 125, media transport 153, media transport 156 by transmissions 224 (schematically shown). Although actuator 126 is illustrated as a single actuator, actuator 126 may alternatively comprise multiple individual actuators associated with individual media transports.

Media interaction device 128 comprises a device configured to interact with media by reading from and/or writing to media. In the particular embodiment shown, media interaction device 128 comprises one or more inkjet printheads. In one embodiment shown, media interaction device 128 includes inkjet printers which are movably supported by a carriage so as to scan across media. In other embodiments, media interaction device 128 may comprise an array of printheads.

Controller 130 comprises a processing unit configured to generate control signals directing operation of actuator 126. In the particular embodiment illustrated, controller 130 further generates control signals directing the operation of media interaction device 128. Controller 130 generates control signals directing operation of actuator 126 based upon a detected or determined position of media within system 110. In the particular example shown, actuator 126 comprises a stepper motor or servo motor configured to enable controller 130 to maintain control and determine the positioning of a sheet of media along media path 122. In other embodiments, system 110 may include one or more sensors, such as sensor 54 (shown and described with respect to FIGS. 1 and 2) for detecting the positions of a sheet of media within system 110.

Output 152 comprises a tray into which completed media is discharged from system 110 for containing or storing such media until retrieved by a person. In the particular example illustrated, output 152 is located on the same side or face of system 110 as media input 120, facilitating single visual inspection and access to both the input and output of system 110. In other embodiments, output 152 may be at other locations.

Media transport 153 comprises a mechanism configured to drive or move media from media support 206 across guide 158 to media transport 156 when rotating in a first clockwise direction as seen in FIG. 4. When rotating in a second opposite counter-clockwise direction as seen in FIG. 4, media transport 153 moves guide 158. In the particular example shown, media transport 153 comprises one or more rollers configured to be rotatably driven by actuator 126. In other embodiments, media transport 153 may comprise belts and the like for moving media.

Media transport 156 comprises a mechanism configured to engage and move media at least partially into output 152 or, alternatively, towards input 120. In the particular example shown, media transport 156 comprises a roller 230 rotatably driven opposite to rotatable star wheels 232. In other embodiments, media transport 156 may comprise other mechanisms such as belts and the like configured to move media at least partially into output 152 and to reverse directions by moving the media towards input 120 without disengaging the media.

Media guide 158 comprises a structure, such as a ramp, configured to guide a sheet of media being moved by media transport 153 towards media transport 156 and to also guide the sheet of media to be moved in a reverse direction away from output 152 towards media input 120. In the particular example shown, media guide 158 is configured to move between a discharge position (shown in FIG. 4) and a duplex position (shown in FIGS. 7-9). In the discharge position, guide 158 rests upon guide support 238 which is connected to a stationary structure such as the housing or frame of system 110. In the duplex position shown in FIGS. 7-9, guide 158 is lifted above support 238 to form a passage 242, allowing a sheet of media to be moved to media input 120.

Figure 10:
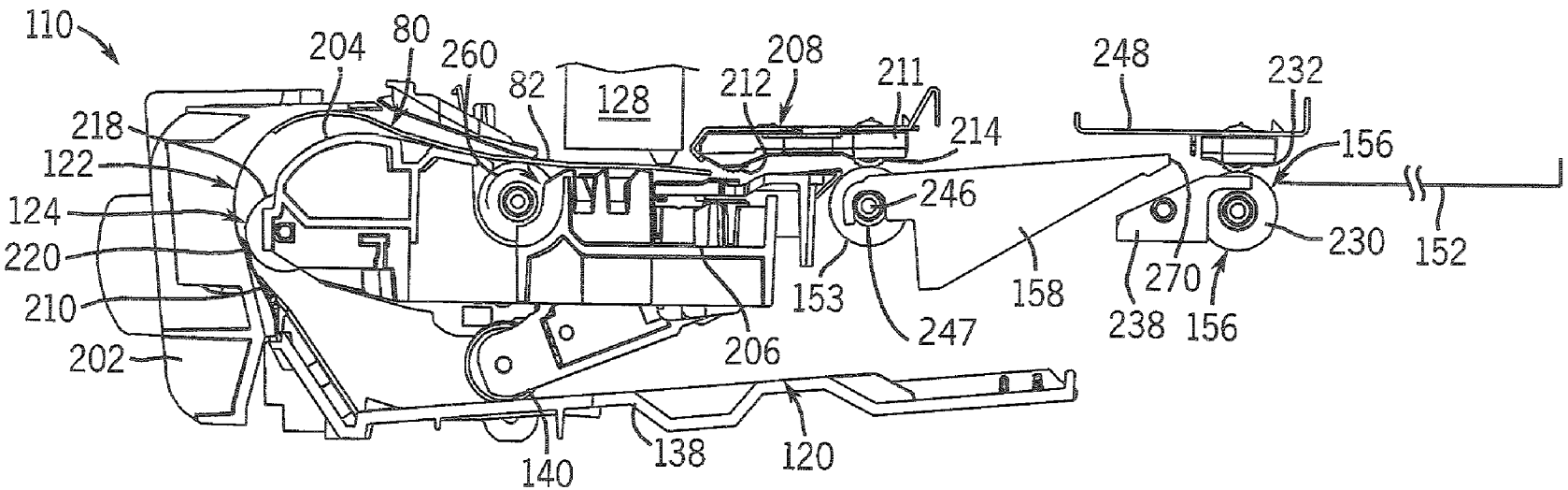
FIG. 10 is a side elevational view of another embodiment of the duplexer system of FIG. 3.

In the particular example illustrated, guide 158 is moved between the discharge position and the duplex position by media transport 153. Guide 158 is operably coupled to media transport 153 such that guide 158 frictionally engages drive shaft 246 of media transport 153. During rotation of shaft 246 by actuator 126 to rotatably drive media transport 153, guide 158 is also rotated with shaft 246 until engaging a lower limit provided by support 238 and an upper limit (not shown). When in engagement with the upper limit or the lower limit, shaft 246 continues to rotate relative to media guide 158 while media guide 158 remains stationary. In other embodiments, structure 248 may alternatively serve as an upper limit for guide 158. In still other embodiments, guide 158 may be operably coupled to shaft 246 by a slip clutch 247 (shown in FIG. 10) or other similar device that enables guide 158 to move during rotation of shaft 246 and that also enables shaft 246 to rotate relative to guide 158.

FIGS. 4-9 illustrate operation of duplexer system 110. As shown by FIG. 4, controller 130 generates control signals directing actuator 126 to rotatably drive pick device 140 in the direction indicated by arrow 252. As a result, sheet 80 having opposite faces 82, 84 and opposite edges 86, 88 is moved from feed tray 138 into media overturning path 122 in the direction indicated by arrow 256. The pick device 140 continues to drive sheet 80 in the direction indicated by arrow 256 until sheet 80 is engaged by roller 218 of media transport 124. Media transport 124 continues to drive sheet 80 through channel 210 so as to overturn sheet 80 and to move sheet 80 into engagement with media transport 125.

Figure 5:
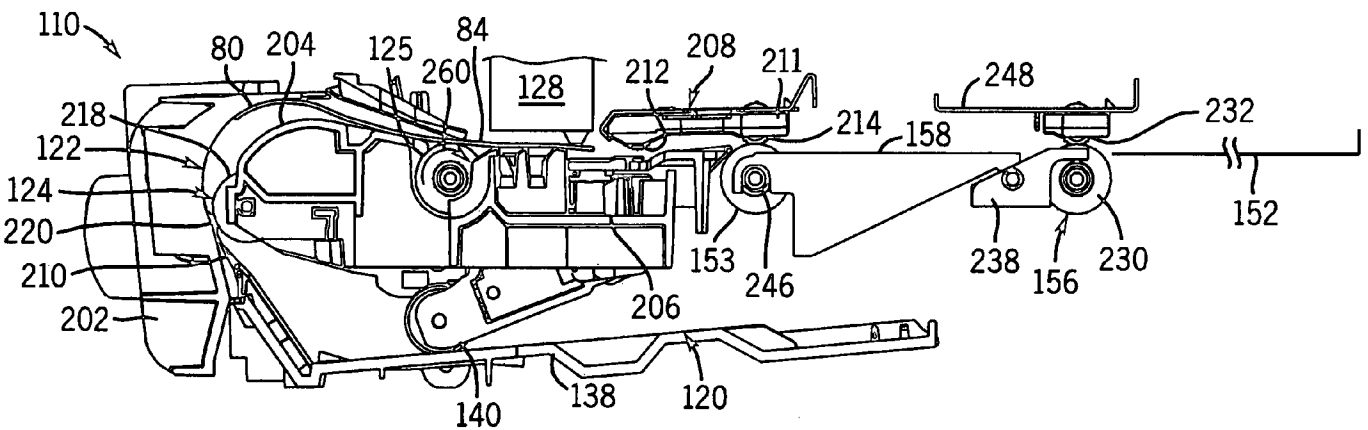
FIG. 5 illustrates a media duplexer system of FIG. 4 further illustrating interaction with a sheet of media according to one example embodiment.

As shown by FIG. 5, controller 130 (shown in FIG. 4) generates control signals directing actuator 126 to rotatably drive media transport 125 in the direction indicated by arrow 260 to further move sheet 80 over media support 206. While sheet 80 is over media support 206, media interaction device 128 interacts with face 84 of sheet 80. In the example shown, media interaction device 128 prints ink or other printing material upon face 84. As sheet 80 is printed upon, media transport 125 moves sheet 80 into engagement with media transport 153.

Figure 6:
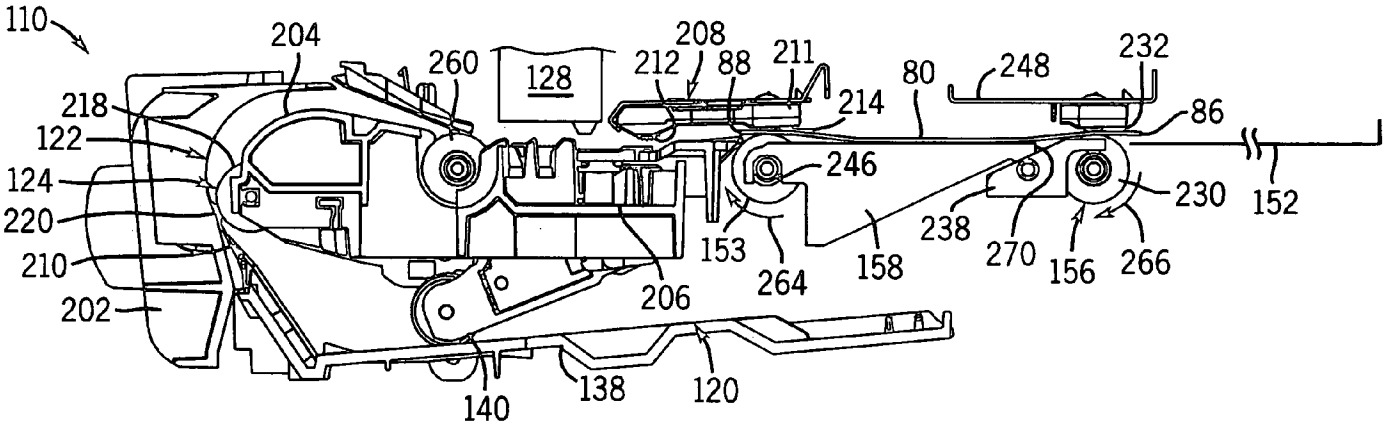
FIG. 6 illustrates the media duplexer system of FIG. 5 further illustrating the sheet of media being directed towards an output by a guide according to one example embodiment.

As shown by FIG. 6, controller 130 (shown in FIG. 4) generates control signals directing actuator 126 to rotatably drive media transport 153 in the direction indicated by arrow 264 so as to move sheet 80 across guide 158 into engagement with media transport 156. Controller 130 generates control signals further directing actuator 126 to rotatably drive roller 230 of media transport 156 in the direction indicated by arrow 266. As a result, edge 86 is driven past media transport 156 into or through media output 152. Media transports 153 and 156 continue to move sheet 80 towards and into output 152 until edge 88 of sheet 80 has been moved past end 270 of guide 158 as detected or otherwise determined by controller 130. Controller 130 generates control signals directing actuator 126 to cease rotatably driving roller 230 of media transport 156 prior to release of sheet 80 from media transport 156. In other words, at least a portion of sheet 80 remains engaged by roller 230 and star wheels 232.

Figure 7:
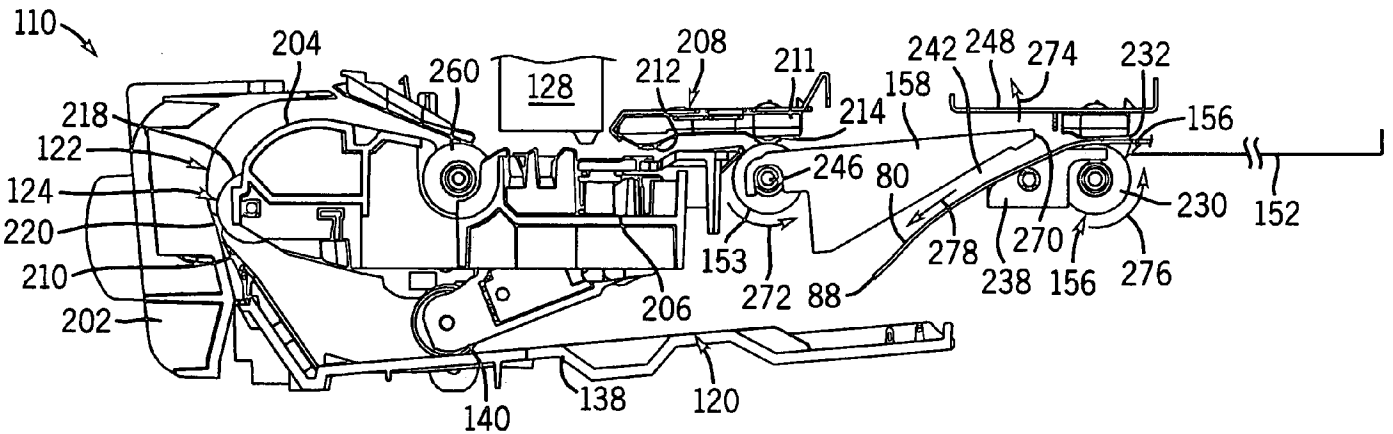
FIG. 7 illustrates the duplexer system of FIG. 6 further depicting the sheet of media being directed to an input by the guide according to one example embodiment.

As shown by FIG. 7, controller 130 (shown in FIG. 4) generates control signals directing actuator 126 to rotatably drive media transport 153 and its shaft 246 in the direction indicated by arrow 272. This results in guide 158 also being rotated in the same direction with shaft 246 so as to lift end 270 from support 238 in the direction indicated by arrow 274 to form passage 242. Controller 130 further generates control signals directing actuator 126 to rotatably drive roller 230 in the direction indicated by arrow 276 so as to move sheet 80 through passage 242 between support 238 and end 270 of guide 158 in the direction indicated by arrow 278 towards input 120. As shown by FIG. 7, edge 88 which was trailing in FIG. 6 becomes a leading edge of sheet 80 as it is moved in the direction indicated by arrow 278. Media transport 156 continues to move sheet 80 in the direction indicated by arrow 278 until sheet 80 is engaged by pick device 140.

Figure 8:
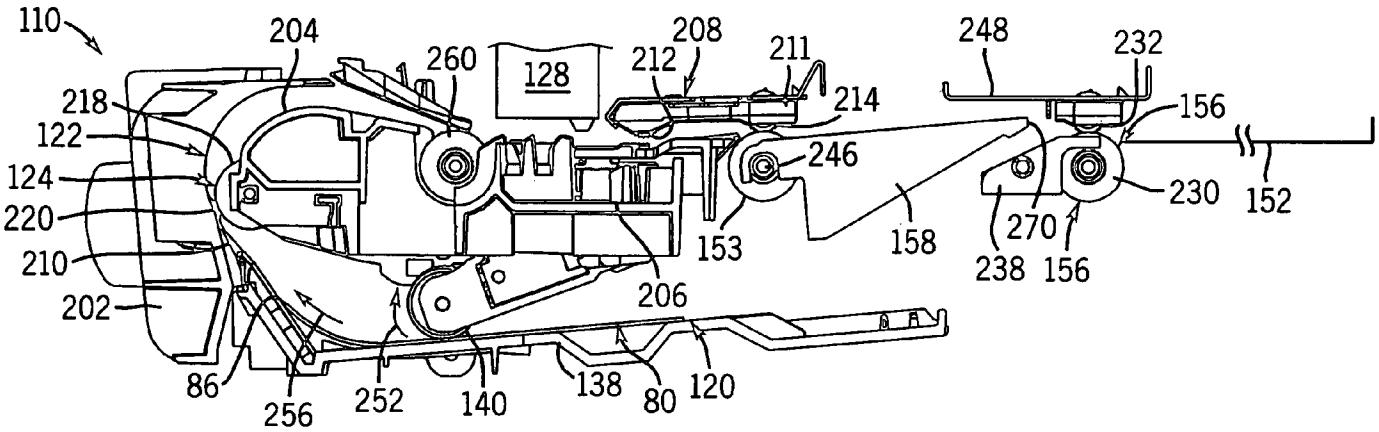
FIG. 8 illustrates the media duplexer system of FIG. 7 further illustrating picking of the sheet of media according to one example embodiment.
Figure 9:
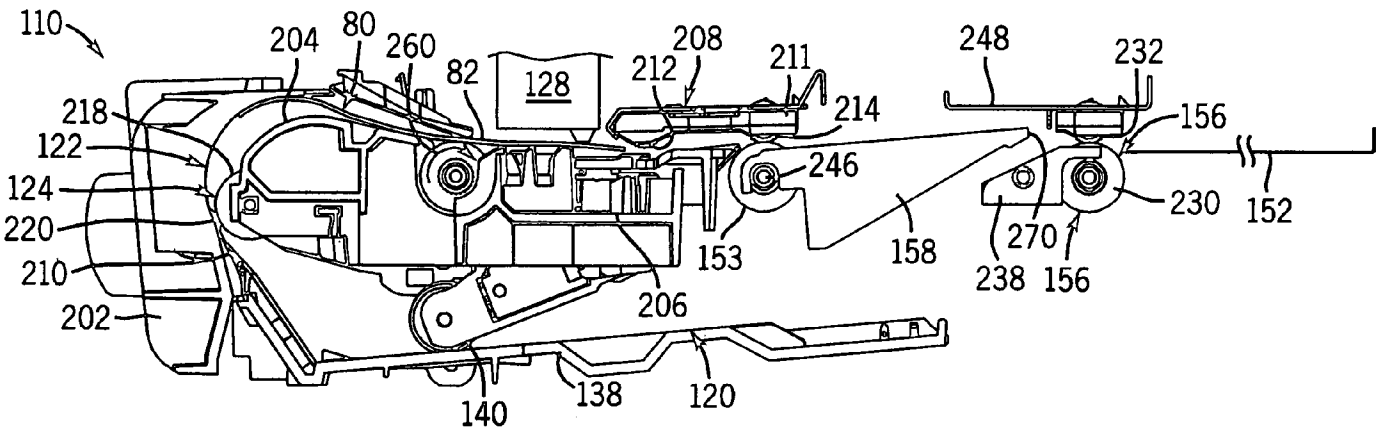
FIG. 9 illustrates the duplexer system of FIG. 8 interacting with a second side of the sheet of media according to one example embodiment.

As shown by FIG. 8, controller 130 (shown in FIG. 4) generates control signals directing actuator 126 to rotatably drive pick device 140 in the direction indicated by arrow 252 to move sheet 80 in the direction indicated by arrow 256 into path 122. As shown in FIG. 9, controller 130 (shown in FIG. 4) generates control signals directing actuator 126 to further drive roller 218 of media transport 124 and media transport 125 to move sheet 80 through media path 122 so as to overturn sheet 80 and to position sheet 80 over media support 206. Controller 130 (shown in FIG. 4) generates control signals directing media interaction device 128 to interact with face 82 of sheet 80. In the example shown, media interaction device 128 comprises an inkjet printhead configured to print one or more inks upon face 82. As a result, both faces 82 and 84 are interacted upon by system 110. Upon completion of interaction with face 82 of sheet 80, sheet 80 is engaged and moved by media transports 153 and 156 and is discharged completely to media output 152. In particular applications, in lieu of being completely discharged from media output 152, sheet 80 may once again be directed back to media input 120 for further interaction.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A duplexer system comprising:

an input;

a path extending from the input and configured to overturn a medium;

an interaction device adjacent the path;

a first transport configured to move the medium in a first direction away from the interaction device and a second direction opposite to the first direction without disengaging the medium; and a guide configured to direct the medium being moved in the second direction by the first transport to the input, wherein the guide is configured to pivot between a first position in which media is directed from the interaction device to the first transport and a second position in which media being moved by the first transport in the second direction is directed to the input;

an actuator operably coupled to the guide and configured to pivot the guide between the first position and the second position; and a second transport configured to move in a third direction to move the medium from the interaction device towards the first transport and a fourth direction to pivot the guide from the first position to the second position.

2. The system of claim 1, wherein the second transport moves relative to the guide when moving in the third direction while the guide is in the first position.

3. The system of claim 2, wherein the second transport comprises a roller.

4. The system of claim 1 further comprising an output tray, wherein the first transport is configured to move the medium in the first direction partially into the output tray and to subsequently move the medium in the second direction without disengaging the medium.

5. The system of claim 1, wherein the input includes:

a feed tray; and a pick device configured to pick a sheet of the medium from the feed tray, wherein the guide is configured to direct the sheet of the medium towards a position in which the sheet of the medium is contacted by the pick device.

6. The system of claim 5, wherein the interaction device at least partially overlies the feed tray.

7. The system of claim 5, wherein the guide is configured to direct the sheet of the medium into the feed tray to a position opposite the pick device.

8. The system of claim 1, wherein the interaction device comprises a printing device.

9. The system of claim 1 further comprising a controller configured to generate control signals, wherein the first transport moves the medium in the first direction in response to the control signals and moves media in the second direction in response to the control signals.

10. The system of claim 9 further comprising at least one sensor configured to sense movement of a trailing edge of the medium past the guide, wherein the controller generates control signals directing the first transport to move the medium in the second direction in response to the at least one sensor sensing movement of the trailing edge past the guide.

11. The system of claim 1, wherein the input includes a pick device and wherein the system further comprises:

an exterior housing having a face;

a first opening along the face through which media is loaded into a position opposite the pick device; and a second opening along the face through which sheets are discharged.

12. The system of claim 1, wherein a driveshaft of the second transport directly engages the guide to move the guide in the fourth direction.

13. The system of claim 1, wherein the second transport is connected to the guide by a slip clutch.

14. A duplexer accessory for use with an interaction system having a path extending from an input having a feed tray and a pick device, the interaction system being configured to overturn media and an interaction device along the path, the accessory comprising:

a transport configured to move a medium in a first direction away from the interaction device and a second direction opposite to the first direction without disengaging the medium; and a guide configured to direct the interacted upon medium to the transport and to guide the media being moved by the transport in the second direction towards a position in which the media is contacted by the pick device, wherein the guide pivots between a first position and a second position and wherein the guide is configured to be operably coupled to an actuator of the interaction system to pivot the guide between the first position and the second position; and a roller operably coupled to the actuator so as to be rotated by the actuator, wherein the roller is connected to the guide by a slip clutch.

15. The accessory of claim 14, wherein the guide in the first position is positioned to direct the medium to the transport and in the second position is positioned to direct the medium being moved by the transport in the second direction to the input.

16. The accessory of claim 14, wherein the transport includes a roller.

17. The accessory of claim 14, wherein the guide is configured to direct the medium into the feed tray to a position opposite the pick device.

18. The accessory of claim 14 further comprising:

an exterior housing having a face;

a first opening along the face through which media is loaded into a position opposite the pick device; and a second opening along the face through which sheets are discharged.

19. A duplexer system comprising:

an input including a feed tray and a pick device opposite the feed tray;

an exterior housing having a face;

a first opening along the face through which media is loaded into a position opposite the pick device;

a second opening along the face through which a medium is discharged;

a path extending from the input and configured to overturn the medium;

an interaction device adjacent the path;

a first transport configured to move the medium in a first direction away from the interaction device and a second direction opposite to the first direction without disengaging the medium;

a guide configured to direct the medium being moved in the second direction by the first transport to the input;

an actuator; and a roller operably coupled to the guide and configured to be driven by the actuator in a first direction to move the medium towards the first transport and in a second direction to pivot the guide.

20. The system of claim 19, wherein the guide is configured to direct the medium towards a position in which the sheet is contacted by the pick device.

21. The system of claim 19, wherein the roller is connected to the guide by a slip clutch.

* * * * *